US006012720A

United States Patent [19]

Webb

[11] Patent Number: 6,012,720

[45] Date of Patent: Jan. 11, 2000

[54] METHOD FOR PLAYING DOUBLE HAND CARD GAMES

[76] Inventor: Derek J. Webb, Farthings, 21 Elgin Ave. Littleover, Derby, United Kingdom, DE23 7SE

[21] Appl. No.: 09/118,069

[22] Filed: Jul. 17, 1998

Related U.S. Application Data

[60] Continuation-in-part of application No. 08/889,919, Jul. 10, 1997, which is a division of application No. 08/504,023, Jul. 19, 1995, Pat. No. 5,685,774.

[30] Foreign Application Priority Data

Jul. 22, 1994 [GB] United Kingdom ..... 9414822
Dec. 29, 1994 [GB] United Kingdom ..... 9426324

[51] Int. Cl.[7] ..... A63F 1/00

[52] U.S. Cl. ..... 273/292; 273/306; 463/13

[58] Field of Search ..... 273/292, 274, 273/309, 306; 463/13, 12

[56] References Cited

U.S. PATENT DOCUMENTS

| | | | |
|---|---|---|---|
| 4,743,022 | 5/1988 | Wood | 463/13 |
| 4,836,553 | 6/1989 | Suttle et al. | 273/292 |
| 5,098,107 | 3/1992 | Boylan et al. | 273/292 |
| 5,174,579 | 12/1992 | Griffiths | 273/292 |
| 5,257,784 | 11/1993 | Boylan et al. | 273/138 |
| 5,257,810 | 11/1993 | Schorr et al. | 273/292 |
| 5,265,877 | 11/1993 | Boylan et al. | 273/139 |
| 5,275,415 | 1/1994 | Wisted | 273/274 |
| 5,288,081 | 2/1994 | Breeding | 273/292 |
| 5,294,128 | 3/1994 | Marquez | 273/292 |
| 5,308,065 | 5/1994 | Bridgeman et al. | 463/13 |
| 5,332,228 | 7/1994 | Schultz | 463/13 |
| 5,366,228 | 11/1994 | Kangsanaraks | 273/292 |
| 5,377,973 | 1/1995 | Jones et al. | 463/12 |
| 5,431,408 | 7/1995 | Adams | 273/306 |
| 5,489,101 | 2/1996 | Moody | 273/292 |
| 5,531,448 | 7/1996 | Moody | 273/292 |
| 5,538,252 | 7/1996 | Green | 273/306 |
| 5,584,486 | 12/1996 | Franklin | 273/292 |
| 5,653,444 | 8/1997 | Dahl | 273/274 |
| 5,673,917 | 10/1997 | Vancura | 273/292 |
| 5,732,950 | 3/1998 | Moody | 273/292 |

FOREIGN PATENT DOCUMENTS 667345 2/1952 United Kingdom .

*Primary Examiner*—Benjamin H. Layno
*Attorney, Agent, or Firm*—Nixon & Vanderhye P.C.

[57] ABSTRACT

Double Hand card games that provide a Double Hand wager with a Copy Hand wager. Each player places a basic Double Hand wager and an optional Copy Hand wager before the cards are dealt. Six cards are dealt to each player with dealer also receiving six cards. Each player and the dealer use Wild Indicia (e.g., a promotional card, a Joker, or an implicit card) to form the best possible five-card high hand (High Hand) and two-card low hand (Low Hand). The High and Low Hands of each player are then compared with the respective High and Low Hands of the dealer and the Double Hand and Copy Hand wagers are settled. The invention advantageously provides fast paced Double Hand games with enhanced player enjoyment and casino advantage.

51 Claims, 1 Drawing Sheet

METHOD FOR PLAYING DOUBLE HAND CARD GAMES

RELATED APPLICATIONS

This is a continuation-in-part of U.S. application Ser. No. 08/899,919, filed Jul. 10, 1997, pending, which is a division of U.S. application Ser. No. 08/504,023, filed Jul. 19, 1995, U.S. Pat. No. 5,685,774.

BACKGROUND OF THE INVENTION

1. Field of the Invention

The invention relates to card games. More particularly, the invention relates to Double Hand card games.

2. Description of Related Art

Double Hand, also commonly known as Pai Gow Poker or Asian Poker, is typically played in a casino or a card club environment. The game was originally based on Chinese Dominoes or Pai Gow. In the card game, a 53-card deck is used consisting of a 52-card standard deck and one Joker card. The game may be played by up to six players and one banker. The dealer, in a casino game, is commonly the banker, whereas in a card club, a player is commonly the banker. As used herein, the dealer is also the banker unless noted otherwise.

A wager is made before cards are dealt. Each player is then dealt a total of 7 cards. The players and the dealer use the dealt cards to form a 5-card high hand (High Hand) and a 2-card low hand (Low Hand). The High Hand is based on typical Poker rankings and the Low Hand is based on pairs and high cards, where the Low Hand is required to be lower in rank than the High Hand. The Joker can be used to improve a hand in a variety of ways, particularly to form a Straight Flush, a Flush, a Straight, or used Is an Ace. The High and Low Hands of each player are then compared with the respective hands of the dealer. Typically, a player wins the wager if both their High and Low Hands are better (higher), in rank, than that of the dealer's respective hands; a player loses the wager if both their High and Low hands are less, in rank, than that of the dealer's respective hands; and if one player hand is better, but the other is less, a tie (known as push) occurs.

The house advantage is generated in two manners. Firstly, a commission based on a percentage (typically 5%) of the winnings is paid on all winning hands. Secondly, the house wins all Copy Hands (i.e., when the player's High or Low Hand is of an equal rank with that of the dealer's respective hand). As such, a player loses with a Copy Hand and a lower ranked other hand and a push occurs when a player has a Copy Hand and a higher ranked other hand.

Although Double Hand is growing significantly, certain rituals and practices of the game have notable drawbacks. One significant drawback is the slow pace of the game. For example, dealers are not permitted to deal cards just to actual players in a regular rotation. Rather, dealers are required to deal all six 7-card hands in every game, regardless of the actual number of players. Another time consuming procedure of the game is that dealers are required to distribute cards by random selection of first player by using dice or an illuminated display from 1 to 6 set into the table to preclude dealers from steering the Joker to a particular player in collusion. In other words, the Joker aspect of the game is detrimental to a fast dealing pace, as casinos need to ensure that the Joker is not manipulated to a specific player. An additional time consuming aspect of the game is the calculation and deduction of the commission on winning wagers, which are not balanced by the much quicker Copy Hand settlement because the incidence of Copy Hands tends to be low. Furthermore, since the game is limited to six players, seven player casino tables are underutilized.

SUMMARY OF THE INVENTION

The invention provides fast pace Double Hand card games with enhanced features. In a casino embodiment, the invention can be played with up to 7 players in connection with a casino-type Blackjack or Poker table and a single standard deck of 52 playing cards. The playing surface of the table includes an area for a Double Hand wager and an extra area for an optional Copy Hand wager. The playing surface also includes High Hand, Low Hand, and Wild Indicia (e.g., for a promotional card, a standard Joker, or an implicit (or imaginary) card) area for each player as well as game rule, payoff scale, and promotional displays.

At the beginning of a game, each player places a Double Hand wager and an optional Copy Hand wager. A dealer deals to each player and self, one card at a time, giving each player and self a total of 6 cards each. Each player and the dealer use the Wild Indicia to create the best possible Double Hand in accordance with the game rules. In one embodiment, the Wild Indicia can be used with 4 cards to form the High Hand or with 1 card to form the Low Hand. The High and Low Hands of each of the players are then compared with those of the dealer and the Double Hand and Copy wagers are settled.

The invention advantageously provides for faster paced Double Hand games than conventional games and other significant benefits. The use of Wild Indicia, rather than a single physical Joker, allows for a faster simple regular deal. The invention also eliminates the commission aspect of conventional Double Hand games and thus provides for fast wager settlements.

Another advantage of the invention is that players are provided the option of an extra side bet (Copy Hand wager), which also acts as a form of insurance against the Copy house advantage. The Wild Indicia also provides the players with the enjoyable perception of being able to form better hands. In addition, embodiments of the invention provide a promotional playing item (e.g., Wild Indicia cards) that casinos can offer with the play of the game.

The invention also accommodates 7 players, thus allowing for the full utility of casino tables. Moreover, the invention does not require the additional safeguards associated with conventional games.

The invention can also be readily implemented in a wide variety of additional forms and media including, single player slot video machines, multi-player slot video machines, electronic games and devices, lottery terminals, scratch-card formats, as well as in-flight, home, and Internet entertainment. Moreover, the invention can be readily implemented in software, which can be stored on a disk (e.g., magnetic disk, compact disk (CD), etc.) and used with a computer system.

The foregoing, and other features and advantages of the invention, will be apparent from the following, more particular description of the preferred embodiments of the invention, the accompanying drawing, and the appended claims.

DETAILED DESCRIPTION OF THE PREFERRED EMBODIMENTS

Figure 1:
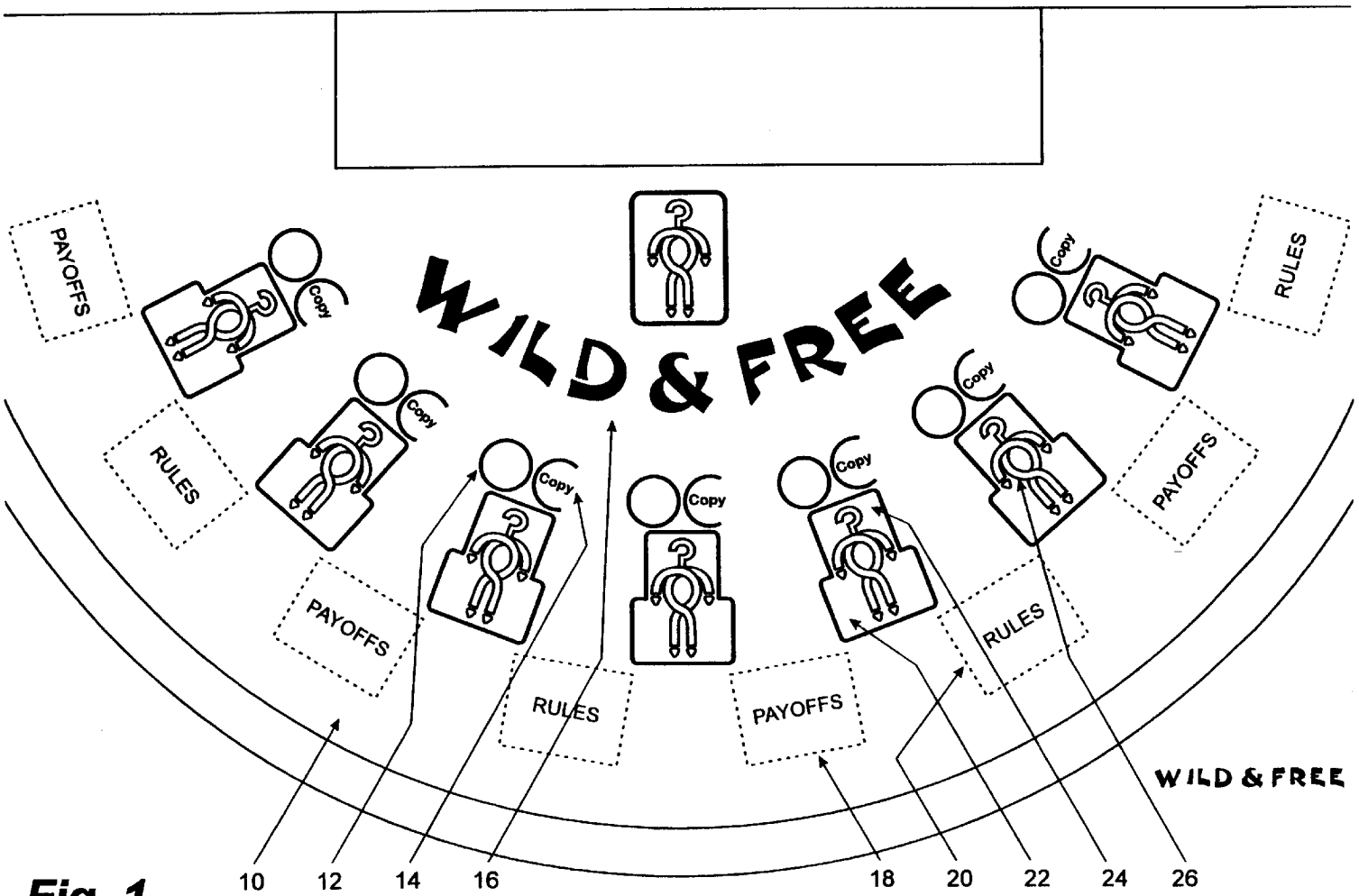
FIG. 1 illustrates a playing surface (or table layout) of a casino-type table in accordance with the invention.

The preferred embodiments of the invention are now described with reference to the figures where like reference numbers indicate like elements.

The first preferred embodiment of the invention is a Double Hand card game used in connection with ai casino-type Blackjack or Poker table and a single standard deck of 52 playing cards. The invention also uses Wild Indicia, such as that disclosed in commonly owned, co-pending U.S. patent application Ser. No. 08/889,919, the disclosure of which is incorporated herein by reference.

FIG. 1 illustrates a playing surface (table layout) 10 of the casino-type table for a plurality of players, which in this embodiment is seven players. For each player, playing surface 10 includes a primary betting area 12 for the placement of a Double Hand wager and a secondary betting area 14, corresponding with each area 12, for an optional Copy Hand wager. Playing surface 10 also includes a High Hand area 22, a Low Hand area 24, and a Wild Indicia insignia area 26 for each player. In addition, playing surface 10 includes a dealer area 16, displays of a predetermined payoff scale 18, and displays of predetermined game rules 20. As would be apparent to one skilled in the relevant art, the predetermined game rules used with any particular embodiment can be based on the teachings of the invention and well known card game principles and casino specific requirements. Other wager areas and information can be displayed on playing surface 10, such as the "Wild & Free" promotional markings illustrated in FIG. 1.

In this embodiment, the Wild Indicia is a specifically designed playing card (not illustrated) with casino details imprinted thereon and of sufficient stock at the table to allow players to retain the Wild Indicia when leaving the table as a memento, good luck item, or promotional item. Alternatively, the Wild Indicia can be used by more than one casino practicing the invention and thus can, for example, have details imprinted thereon promoting a collection of casinos. The Wild Indicia in this embodiment is also individually held by each player and dealer and retained from hand to hand.

Other forms of Wild Indicia, however, can be used with the invention. For example, the Wild Indicia can be a regular Joker. The Wild Indicia can alternatively be an insignia set onto table layout 10 for each player and dealer, and used by placing appropriate cards from the hand adjacent to and in order with the insignia. In yet another embodiment of the invention, the Wild Indicia is a predetermined rule advising that each player and dealer have an implicit (or imaginary) card, rather than Wild Indicia insignia, to add to the dealt cards and form their respective hands for comparison and settlement (payoff). As would be apparent to one skilled in the relevant art, other forms of Wild Indicia can be practiced with the invention.

Wagers are placed prior to the dealing of cards. In this preferred embodiment, each player must place a Double Hand wager at primary area 12 to participate in the basic game. Each player, however, has the option to place an additional Copy Hand wager at secondary area 14. In another embodiment of the invention, both the Double Hand and Copy Hand wagers are required and in another embodiment only the Copy Hand wager is required. The allowable limit of the Copy Hand wager is both governed by the predetermined game rules and relative to the amount of the Double Hand wager.

A dealer deals to each player and self in rotation, one card at a time, giving each player and self a total of 6 cards each. In this embodiment, the dealer is also a banker. However, in other embodiments of the invention, the banker can be either the dealer or one of the players. Each player uses the Wild Indicia to create the best possible Double Hand in accordance with the predetermined game rules. In this embodiment, the Wild Indicia can be used with 4 cards to form the High Hand or with 1 card to form the Low Hand. Alternatively, the Wild Indicia can be restricted to either High or Low Hands or in accordance with the particular game rules of the casino. In this embodiment, the Wild Indicia can be used with a High Hand to form a Straight Flush, a Flush, a Straight, or used as an Ace. The Wild Indicia can also be used with a Low Hand as an Ace. However, other Wild Indicia game rules can be practiced with the invention. For example, the Wild Indicia can be used as an Ace only for a High Hand or the Wild Indicia can be broadly used as any card.

In accordance with the particular game rules, each player thus determines the best way to make a High Hand and a Low Hand using the Wild Indicia. Each player then places their High and Low Hands in areas 22 and 24, respectively. The dealer, also in accordance with the same predetermined game rules, forms the dealer's High and Low Hands and places the cards within dealer area 16. In an alternative embodiment, the Wild Indicia of the dealer can have more play options with respect to the Wild Indicia than player. For example, the dealer can be given the option of using the Wild Indicia as an Ace in either High or Low Hands and the players can be restricted to using the Wild Indicia as an Ace only in High Hands. The following is the hand ranks, in descending order, of this preferred embodiment:

| | |
|---|---|
| High Hand | |
| Five Aces | Four Aces and Wild Indicia |
| Straight Flush | Five suited in sequence (includes Royal Flush) |
| Four of a Kind | Four of same rank |
| Full House | Three of same rank and two of another rank |
| Flush | Five suited |
| Straight | Five in sequence |
| Three of a Kind | Three of same rank |
| Two Pair | Two of same rank and two of another rank |
| One Pair | Two of same rank |
| High Card | None of the above |
| Low Hand | |
| Pair | Two of same rank |
| High Card | No pair. |

The player's hands are compared with the dealer's hands and settled, in rotation, with first the Double land wager at 12 being settled, then the Copy Hand wager at 14. In this preferred embodiment, the predetermined rules include standard Double Hand rules where a player wins if both that player's High and Low Hands are better (higher) than the dealer's High and Low Hands, respectively; a player loses if both that player's High and Low Hands are less than the dealer's High and Low Hands, respectively; and a pushes occurs if either a player's High or low Hand (but not both), is better than the dealer's High or Low Hand, respectively.

With respect to the Copy Hand wager, in this preferred embodiment, the dealer wins a Low Copy and the player wins a High Copy. Accordingly, the player wins with a High Copy and a Low Hand win; a push occurs with a High Copy and a Low Hand loss; a push occurs with a Low Copy and a High Hand win; the player loses with a Low Copy and a High Hand loss; and a push occurs with a High Copy and a Low Copy. With the invention, no commission is required since the incidence of Copy Hands is sufficiently high due to the use of Wild Indicia to provide an adequate house advantage.

Alternative embodiments can enable a variety of possible house advantages. For example, the invention can be practiced with any of the following: player wins Natural only and dealer wins Wild and Semi-Wild (any copy when neither the dealer nor the player is using Wild Indicia in copy, or when only the player or the dealer (but not both) is using Wild Indicia in copy); player wins Natural and Semi-Wild and dealer wins Wild only; player wins Natural or Semi-Wild Copy and dealer wins Wild Copy, where Wild Indicia is used by the player and the dealer in copy; or player wins all High Hand Copies and Low Hand Natural and dealer wins Low Hand Semi-Wild and Wild.

Once the hands have been compared, the wagers are settled. The basic Double Hand wager is taken, pushed, or paid at 1 to 1 accordingly. It would be apparent to one skilled in the relevant art that, the invention can be readily practiced with the particular casino predetermined rules (House Way) of settling the High and Low Double Hands. Also in this embodiment, the Copy Hand wager is taken if there is no Copy Hand or paid if that player and dealer have a copy. As shown below, the Copy Hand payoff scale indicates the lowest payoff for a Low Copy, a medium payoff for a High Copy, and the highest payoff for a Double Hand High and Low Copy, reflecting the degree of difficulty in attaining each Copy Hand. Copy win scale of this preferred embodiment is within the following ranges:

| Copy Hand Payoffs | |
|---|---|
| Low Copy | 1 to 1 up to 10 to 1 |
| High Copy | 10 to 1 up to 100 to 1 |
| Double Copy | 100 to 1 up to 1000 to 1. |

In another embodiment, the payoff scale could offer a variety of odds dependent upon whether the Copy was a Natural (no Wild Indicia), Semi-Wild (ore Wild Indicia) or Wild (two Wild Indicia). Once the wagers have been settled, the player retains the Wild Indicia (if a physical item is used), the cards are shuffled and the next round proceeds. In such an embodiment, the copy win scale ranges can be as follows:

| Copy Hand Payoffs | |
|---|---|
| Wild Low Copy | 1 to 1 up to 5 to 1 |
| Semi Wild Low Copy | 2 to 1 up to 10 to 1 |
| Natural Low Copy | 5 to 1 up to 50 to 1 |
| Wild High Copy | 5 to 1 up to 50 to 1 |
| Semi Wild High Copy | 10 to 1 up to 100 to 1 |
| Natural High Copy | 25 to 1 up to 1000 to 1 |
| Any Double Copy | 1000 to 1 up to 5000 to 1. |

The invention accordingly provides fast paced Double Hand games. The use of Wild Indicia, rather than a single physical Joker, allows for a faster simple regular deal. The invention also eliminates the commission aspect of conventional Double Hand games which provides for quick settlements.

Another advantage of the invention is that players are provided the option of an extra side bet (Copy Hand wager), which also acts as a form of insurance against the Copy house advantage. The Wild Indicia also provides the players with the enjoyable perception of being able to form better hands. In addition, embodiments of the invention provide a promotional playing item (e.g., Wild Indicia cards) that casinos can offer with the play of the game.

The invention also accommodates 7 players, thus allowing: for the full utility of casino tables. Moreover, the invention does not require the additional safeguards associated with conventional games.

As would be apparent to one skilled in the art, the invention can be embodied in a wide variety of forms and media including, but not limited to, single player slot video machines, multi-player slot video machines, electronic games and devices, lottery terminals, scratch-card formats, as well as, in-flight, home, and Internet entertainment. For example, the invention can be readily implemented as a computer program product (e.g., floppy disk, compact disk (CD), etc.) comprising a computer readable medium having control logic recorded therein to implement the features of the invention as described in relation to the other preferred embodiments. The control logic can be loaded into the memory of a computer and executed by a central processing unit (CPU) to perform the operations described herein.

Although the invention has been particularly shown and described with reference to several preferred embodiments thereof it will be understood by those skilled in the relevant art that various changes in form and details may be made therein without departing from the spirit and scope of the invention as defined in the appended claims.

What is claimed is:

1. A method of playing a card game, comprising the steps of:

providing at least one deck of playing cards;

dealing six cards to a player and a dealer;

receiving a player high hand of five cards and a player low hand of two cards, wherein said player hands include said six cards dealt to said player and wild indicia, assigning said wild indicia as a seventh card; and forming a dealer high hand of five cards and a dealer low hand of two cards, wherein said dealer hands include said six cards dealt to said dealer and wild indicia.

2. The method of claim 1, further comprising the steps of:

receiving a first wager from said player; and receiving a second wager from said player.

3. The method of claim 2, wherein said first wager is a double hand wager and said second wager is a copy hand wager.

4. The method according to claim 3, wherein said dealer wins all copies.

5. The method according to claim 3, wherein a high hand copy is won by said player.

6. The method according to claim 3, wherein a low hand copy is won by said dealer.

7. The method according to claim 3, wherein a high hand and a low hand copy is a push.

8. The method according to claim 3, wherein a natural copy is won by said player.

9. The method according to claim 3, wherein a semi-wild copy is won by said player.

10. The method according to claim 3, wherein a wild copy is won by said dealer.

11. The method according to claim 3, wherein a double hand rank, in descending order, is:

| High Hand | |
|---|---|
| Five of a Kind | Four of same rank and Wild Indicia |
| Straight Flush | Five suited in sequence, including Royal Flush |
| Four of a Kind | Four of same rank |
| Full House | Three of same rank with two of another rank |
| Flush | Five suited |
| Straight | Five in sequence |

-continued

| | |
|---|---|
| Three of a Kind | Three of the same rank |
| Two Pair | Two of same rank with two of another rank |
| One Pair | Two of same rank |
| High Card | None of the above |
| Low Hand | |
| Pair | Two of same rank |
| High Card | No pair. |

12. The method of claim 2, wherein said first wager is required and said second wager is optional.

13. The method of claim 2, wherein said first wager and said second wager are required.

14. The method of claim 2, further comprising the steps of:

providing said player a first area to place said first wager; and providing said player a second area to place said second wager.

15. The method of claim 2, further comprising the steps of:

comparing said player high hand and said player low hand with said dealer high hand and said dealer low hand, respectively; and resolving said first wager and said second wager.

16. The method of claim 15, wherein said resolving step includes using predetermined rules.

17. The method of claim 15, wherein said resolving step includes using a predetermined payoff scale.

18. The method according to claim 2, wherein another player is a banker.

19. The method according to claim 2, wherein said dealer is a banker.

20. The method according to claim 2, wherein a copy wager payoff scale is:

| | |
|---|---|
| Low Copy | 1 to 1 up to 10 to 1 |
| High Copy | 10 to 1 up to 100 to 1 |
| Double Copy | 100 to 1 up to 1000 to 1. |

21. The method according to claim 2, wherein a copy wager payoff scale is:

| | |
|---|---|
| Wild Low Copy | 1 to 1 up to 5 to 1 |
| Semi Wild Low Copy | 2 to 1 up to 10 to 1 |
| Natural Low Copy | 5 to 1 up to 50 to 1 |
| Wild High Copy | 5 to 1 up to 50 to 1 |
| Semi Wild High Copy | 10 to 1 up to 100 to 1 |
| Natural High Copy | 25 to 1 up to 1000 to 1 |
| Any Double Copy | 1000 to 1 up to 5000 to 1. |

22. The method according to claim 1, wherein said wild indicia are specifically designated promotional cards.

23. The method according to claim 1, wherein said wild indicia are regular jokers.

24. The method according to claim 1, wherein said wild indicia are table insignia.

25. The method according to claim 1, wherein said wild indicia are implicit in accordance with predetermined rules.

26. The method according to claim 1, wherein said wild indicia represents any card.

27. The method according to claim 16, wherein said wild indicia can be used only in a straight flush, a flush, a straight, or used as an ace.

28. The method according to claim 16, wherein said wild indicia can be used in said player high or low hand and said dealer high or low hand.

29. The method according to claim 16, wherein said wild indicia can be used in said player high hand only and said dealer high hand or low hand.

30. The method according to claim 1, wherein said method is performed by a video machine.

31. The method according to claim 30, wherein said video machine is a multi-player slot video machine.

32. The method cording to claim 1, wherein said method is performed by an electronic game.

33. The method according to claim 1, wherein said method is performed by a lottery terminal.

34. The method according to claim 1, wherein said method is performed in conjunction with the Internet.

35. The method according to claim 1, wherein said method is implemented in software.

36. The method according to claim 1, wherein said method is a casino card game.

37. The method according to claim 1, wherein said dealing step provides said cards to said player and said dealer one at a time in rotation.

38. A method of playing a card game, comprising the steps of:

providing at least one deck of playing cards;

a player placing a double hand wager;

said player placing a copy wager;

dealing six cards to said player and a dealer;

forming a player high hand of five cards and a player low hand of two cards, wherein said player hands include said six cards dealt to said player and wild indicia, assigning said wild indicia as a seventh card; and forming a dealer high hand of five cards and a dealer low hand of two cards, wherein said dealer hands include said six cards dealt to said dealer and wild indicia.

39. The method of claim 38, wherein said double hand wager is required and said copy wager is optional.

40. The method of claim 38, wherein said double hand wager and said copy wager are required.

41. The method according to claim 38, wherein said player places said double hand wager in a primary area and said copy wager in a secondary area.

42. The method according to claim 41, wherein said primary and secondary areas are on a casino table.

43. The met cording to claim 38, wherein said player high and low hands are placed in predetermined areas of a casino table.

44. The method of claim 38, further comprising the steps of:

comparing said player high hand and said player low hand with said dealer high hand and said dealer low hand, respectively; and resolving said double hand wager and said copy wager.

45. The method of claim 44, wherein said resolving step includes using predetermined rules.

46. The method of claim 44, wherein said resolving step includes using predetermined payoffs.

47. A method of playing a card game, the method embodied in a computer program product for use with a computer system, the computer program product comprising a computer usable medium having computer readable program code means embodied in the medium for performing the steps of the method, the method comprising the steps of:

providing at least one deck of playing cards;

dealing six cards to a player and a dealer;

receiving a player high hand of five cards and a player low hand of two cards, wherein said player hands include said six cards dealt to said player and wild indicia, assigning said wild indicia as a seventh card; and forming a dealer high hand of five cards and a dealer low hand of two cards, wherein said dealer hands include said six cards dealt to said dealer and wild indicia.

48. The method according to claim 47, further comprising the steps of:

receiving a first wager from said player; and receiving a second wager from said player.

49. The method of claim 48, wherein said first wager is a double hand wager and said second wager is a copy hand wager.

50. The method of claim 48, wherein said first wager is required and said second wager is optional.

51. The method of claim 48, wherein said first wager and said second wager are required.

* * * * *

UNITED STATES PATENT AND TRADEMARK OFFICE

CERTIFICATE OF CORRECTION

PATENT NO. : 6,012,720
DATED : January 11, 2000
INVENTOR(S) : Webb

It is certified that error appears in the above-identified patent and that said Letters Patent is hereby corrected as shown below:

Column 1, line 34, delete "Is" and insert --as--.

Column 3, line 7, delete "ai" and insert --a--.

Column 5, line 35, delete "ore" and insert --one--.

Signed and Sealed this

Seventh Day of November, 2000

*Attest:*

Q. TODD DICKINSON

*Attesting Officer*

*Director of Patents and Trademarks*